US006452327B1

(12) United States Patent
Chen et al.

(10) Patent No.: US 6,452,327 B1
(45) Date of Patent: Sep. 17, 2002

(54) FLUORESCENT LAMP MODULE STRUCTURE

(75) Inventors: Chih-Fang Chen; Ruey-Feng Jean; Lai-cheng Chen; Kuang-lung Tsai, all of Hsin Chu (TW)

(73) Assignee: Delta Optoelectronics, Inc. (TW)

( * ) Notice: Subject to any disclaimer, the term of this patent is extended or adjusted under 35 U.S.C. 154(b) by 56 days.

(21) Appl. No.: 09/755,901

(22) Filed: Jan. 3, 2001

(51) Int. Cl.[7] ..... H01J 1/62
(52) U.S. Cl. ..... 313/493
(58) Field of Search ..... 313/493, 573, 313/634, 512; 22/2.1 R

*Primary Examiner*—Vip Patel

(74) *Attorney, Agent, or Firm*—Martine & Penilla, LLP

(57) ABSTRACT

A fluorescent lamp module structure includes a Cold Cathode Flat Fluorescent Lamp (CCFFL) and a combine metallic housing for containing and positioning the CCFFL. The CCFFL is a rectangular box with a certain thickness including a 1$^{st}$ side, a 2$^{nd}$ side, a 3$^{rd}$ side and a 4 side. The 1$^{st}$ side includes a 1$^{st}$ end with a 1$^{st}$ electrode, a 2$^{nd}$ end with a 2$^{nd}$ electrode and a middle section with a exhaust tube. Moreover, the combined metallic housing is composed of a plurality of metallic housing portions cut from an integrated metallic housing. The integrated metallic housing is composed of a base plate and a plurality of upright pieces bent upward at a right angle to the base plate, and having height close to the thickness of CCFFL. Furthermore, the plurality of metallic housing portions is formed by a plurality of base plate areas, adjacent to one another, cut from the base plate of the integrated metallic housing.

7 Claims, 4 Drawing Sheets

—◆— naked piece of the flat lamp
—■— after the metallic housing is added
—▲— after the combined metallic housing is added

FLUORESCENT LAMP MODULE STRUCTURE

FIELD OF THE INVENTION

The invention relates to a fluorescent lamp module structure, and more particularly, relates to a combined metallic housing which contains and positions a Cold Cathode Flat Fluorescent Lamp (CCFFL), and does not affect the distribution of its electrical field after the fluorescent lamp module structure is assembled, and also improves its luminance uniformity.

BACKGROUND OF THE INVENTION

FIG. 1 is an exploded view of the fluorescent lamp module structure according to the prior art. As shown in FIG. 1, the fluorescent lamp module structure of the prior art includes a CCFFL 10 and an integrated metallic housing 20.

The CCFFL 10 being a rectangular box with certain thickness, includes a $1^{st}$ side 11 on the top, a $2^{nd}$ side 13 on the bottom, a $3^{rd}$ side 15 on the left and a $4^{th}$ side 17 on the right. The $1^{st}$ side includes a $1^{st}$ end 12 on the left, a $2^{nd}$ end on the right, and a middle section between the $1^{st}$ end 12 and the $2^{nd}$ end 14. Furthermore, the $1^{st}$ end 12 has a $1^{st}$ electrode 22, the $2^{nd}$ end 14 has a $2^{nd}$ electrode 24, and the middle section 16 has an exhaust tube 26.

The integrated metallic housing 20 is composed of a base plate 25 and a plurality of upright piece 28 bent upward at a right angle to the base plate 25 with a height that is close to the thickness of the CCFFL 10 for containing and positioning the CCFFL 10.

The air in the sealed chamber (not shown) of CCFFL 10 is drawn out through the exhaust tube 26 and changed into inert gas or mercury vapor. Afterward, a high voltage is applied between the electrodes 12 and 14 to induce electrons jumping from one electrode to another making the electrons collides with gas molecules to excite the inert gas or mercury vapor in the sealed chamber so as to radiate ultraviolet light. In this way, the ultraviolet light can excite "the phosphor coating" coated on the interior wall of the CCFFL 10 and generate luminescence.

FIG. 2 shows the curves illustrating the effect on the uniformity of a flat lamp when an integrated metallic housing is added. As shown in FIG. 2, the abscissa represents ten samples of the flat lamp, and each sample has nine test points (not shown in the figure) showing the luminance of the uniformly distributed areas. In addition, the ordinate represents the luminescent uniformity. Each sample's luminescent uniformity is defined as the ratio in percentage value of the lowest illumination to the highest illumination of the same sample among the nine illumination test points.

Curve 2*a* shows the luminescent uniformity of naked piece of the flat lamp before the integrated metallic housing 20 is added. Curve 2*b* shows the luminescent uniformity of the flat lamp after integrated metallic housing is added. From the curve 2*a* and 2*b* of the FIG. 2, we can see the luminescent uniformity of the CCFFL 10 of the fluorescent lamp module structure of the prior art is lowered in a great extent from an average of 90% before assembling to an average of 50% after assembling. This is due to the combination of the CCFFL 10 with the integrated metallic housing 20 that greatly affects the electric field.

SUMMARY OF THE INVENTION

In the light of the above-mentioned disadvantage of the prior art, the invention provides a fluorescent lamp module structure including a CCFFL and a combined metallic housing for containing and positioning the CCFFL. The CCFFL being a rectangular box with a certain thickness including a $1^{st}$ side, a $2^{nd}$ side, a $3^{rd}$ side and a $_4$th side. Furthermore, the $1^{st}$ side includes a $1^{st}$ end having a $1^{st}$ electrode, a $2^{nd}$ end having a $2^{nd}$ electrode and a middle section having an exhaust tube.

In addition, the combined metallic housing is composed of a plurality of "metallic housing portions" cut from an integrated metallic housing. The integrated metallic housing is composed of a base plate and a plurality of upright piece bent upward at a right angle to the base plate with a height close to the thickness of the CCFFL. Moreover, a plurality of metallic housing portions is formed by a plurality of base plates, which are adjacent to one another, cut from the base plate of the integrated metallic housing. Thus, a plurality of metallic housing portions, adjacent to one another, can efficiently eliminate the effect on the electric field resulting from the adding of integrated metallic housing while the CCFFL is operating. It can restore the luminescent uniformity in a great extent, thereby, greatly improve the quality of the image display.

Regarding the invention's object, advantages and characteristics as above-mentioned or others can be better understood by the following "detailed description of the preferred embodiments".

DETAIL DESCRIPTION OF THE PREFERRED EMBODIMENTS

Figure 3:
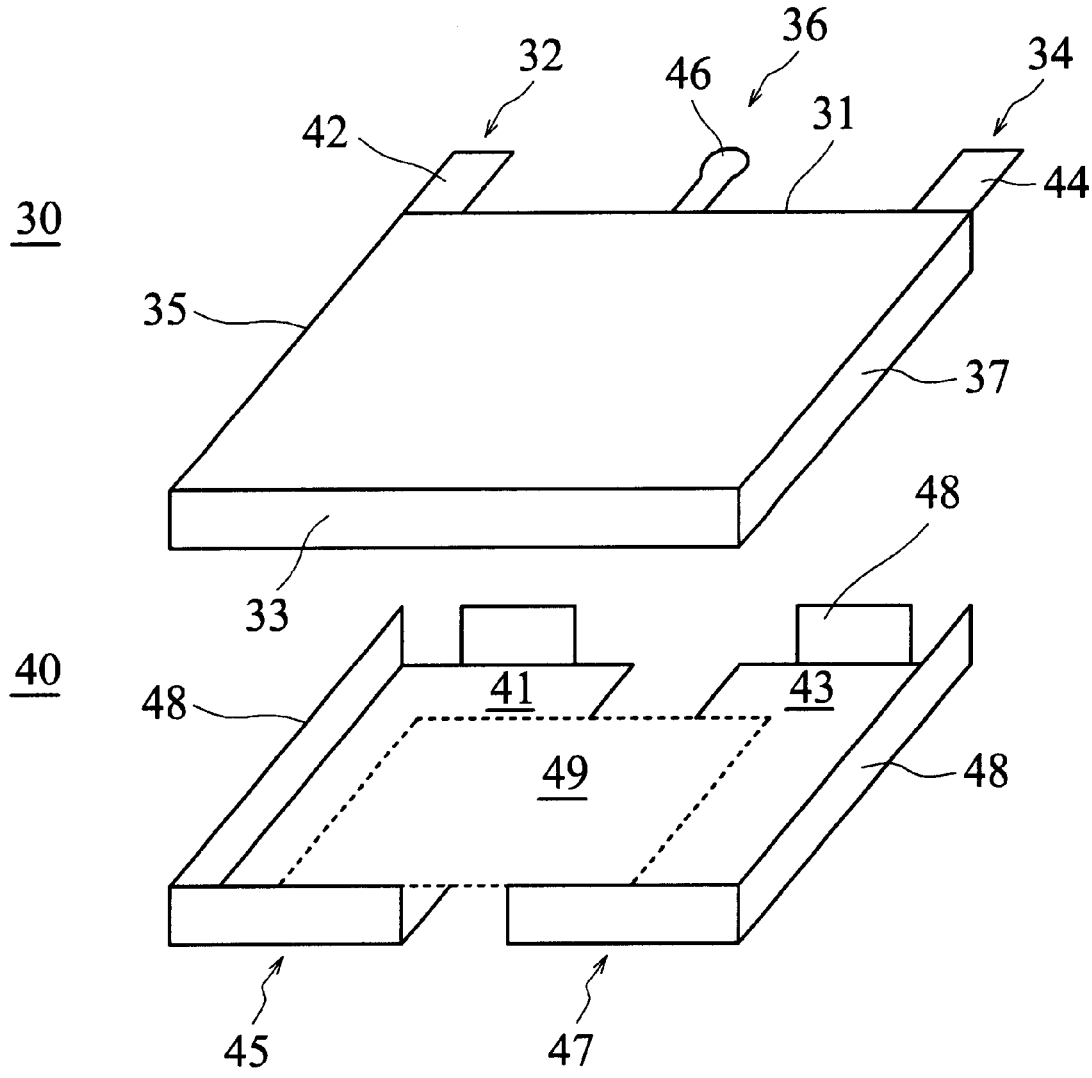
FIG. 3 is an exploded view of the fluorescent lamp module structure in accordance with the invention.

FIG. 3 is an exploded view of the fluorescent lamp module structure of the invention. The invention includes a CCFFL 30 and a combined metallic housing 40. The CCFFL 30 being a rectangular box with a certain thickness including a $1^{st}$ side 31 on the top, a $2^{nd}$ side 33 on the bottom, a $3^{rd}$ side 35 on the left, and a $4^{th}$ side 37 on the right. The $1^{st}$ side 31 includes a $1^{st}$ end 32 on the left, a $2^{nd}$ end 34 on the right and a middle section 36 between the $1^{st}$ end 32 and $2^{nd}$ end 34. Furthermore, the $1^{st}$ end 32 has an electrode 42, the $2^{nd}$ end 34 has an electrode 44 and the middle section 36 has an exhaust tube 46.

Figure 1:
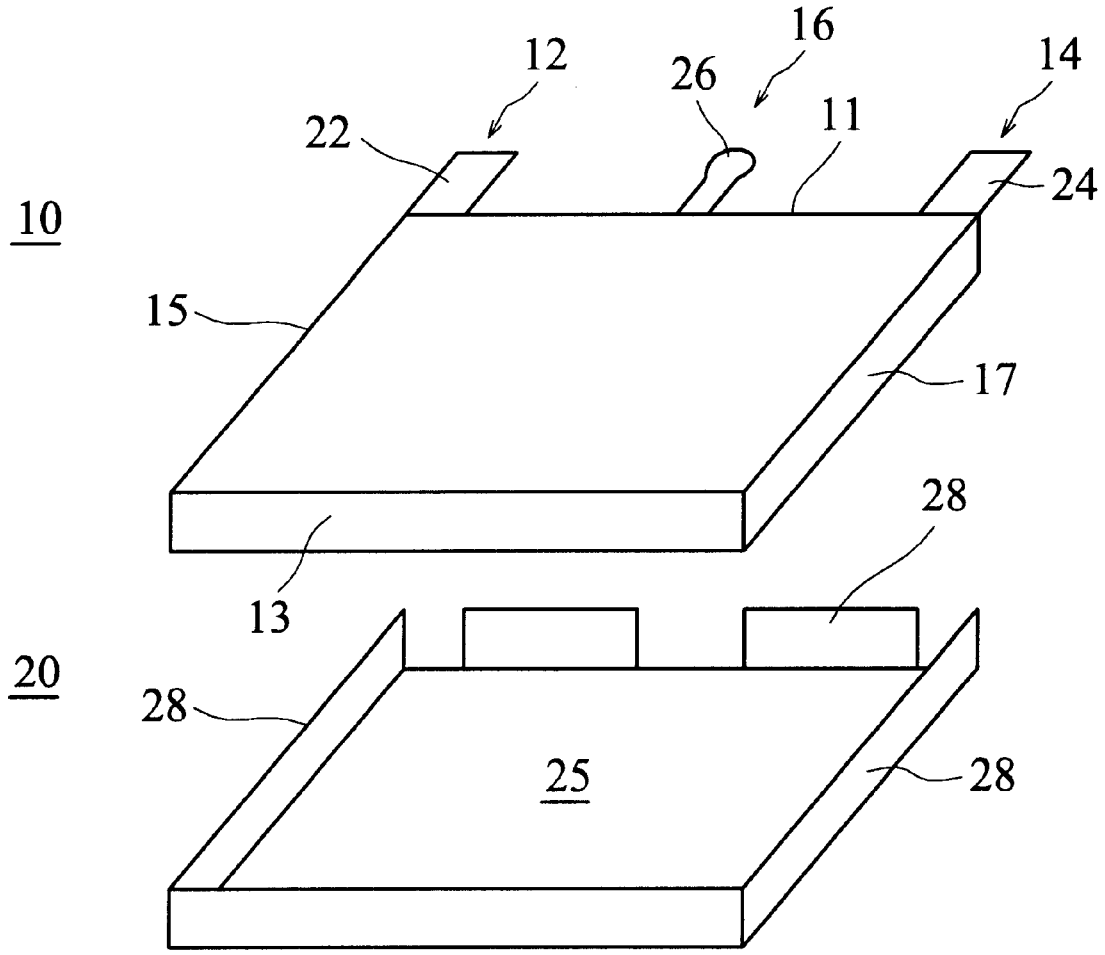
FIG. 1 (PRIOR ART)
FIG. 1 is an exploded view of the fluorescent lamp module structure according to a prior art.
Figure 2:
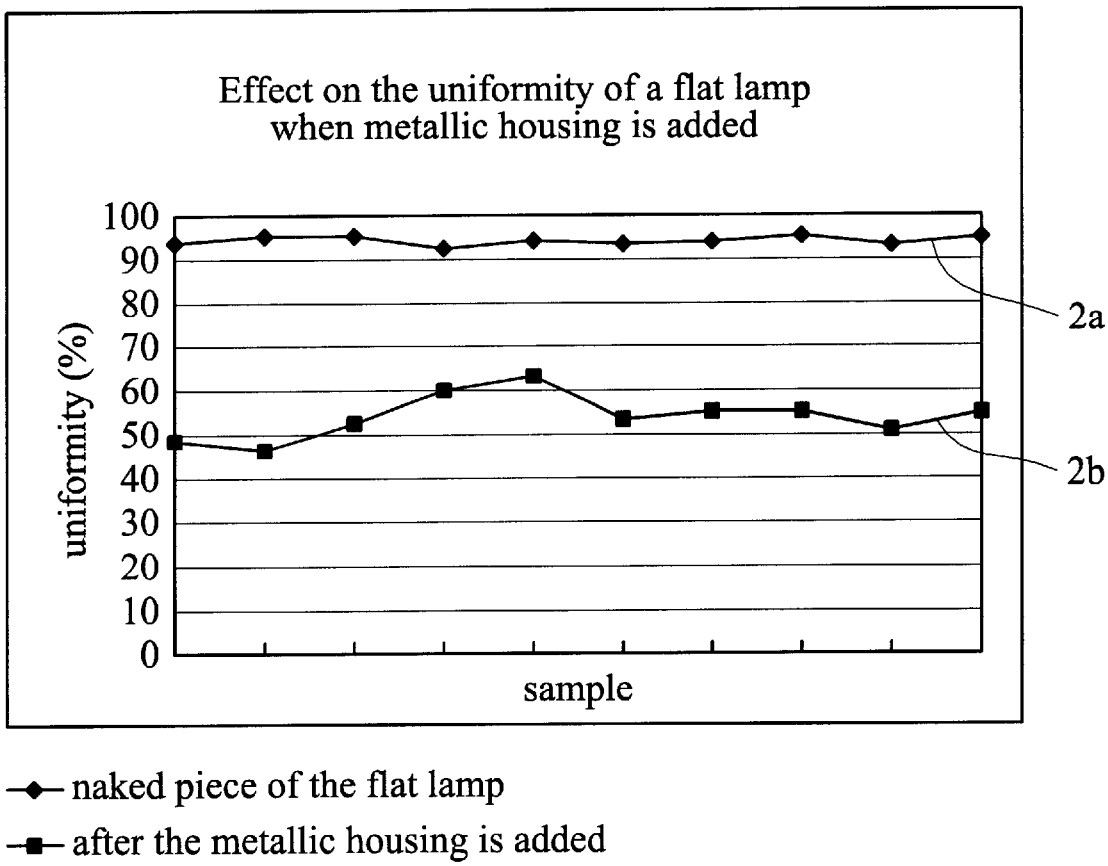
FIG. 2 (PRIOR ART)
FIG. 2 shows the curves illustrating the effect on the uniformity of a flat lamp when an integrated metallic housing is added according to a prior art.

The combined metallic housing 40 being provided to contain and position the CCFFL 30 is composed of two metallic housing portions 45 and 47 which are cut from the integrated metallic housing 20 as shown in the FIG. 1. An insulated paster 49 can also be added to combine the two metallic housing portions 45 and 47. The integrated metallic housing 20 (as shown in FIG. 1) is composed of a base plate 25 and a plurality of upright piece 28 bent upward at a right angle to the base plate and had height close to the thickness of CCFFL 10. The two metallic housing portions 45 and 47 are formed by two base plates, which are adjacent to each other, cut from the base plate of the integrated metallic housing 20. The cutting line is positioned between the $3^{rd}$ side and $4^{th}$ side of the CCFFL 30 to become two neighboring base plates. Each of the metallic housing 45 or 47 is composed of a base plate 41 or 43 as well as a plurality of upright piece 48 bent upward at a right angle to the base plate and had height close to the thickness of CCFFL 30.

Figure 4:
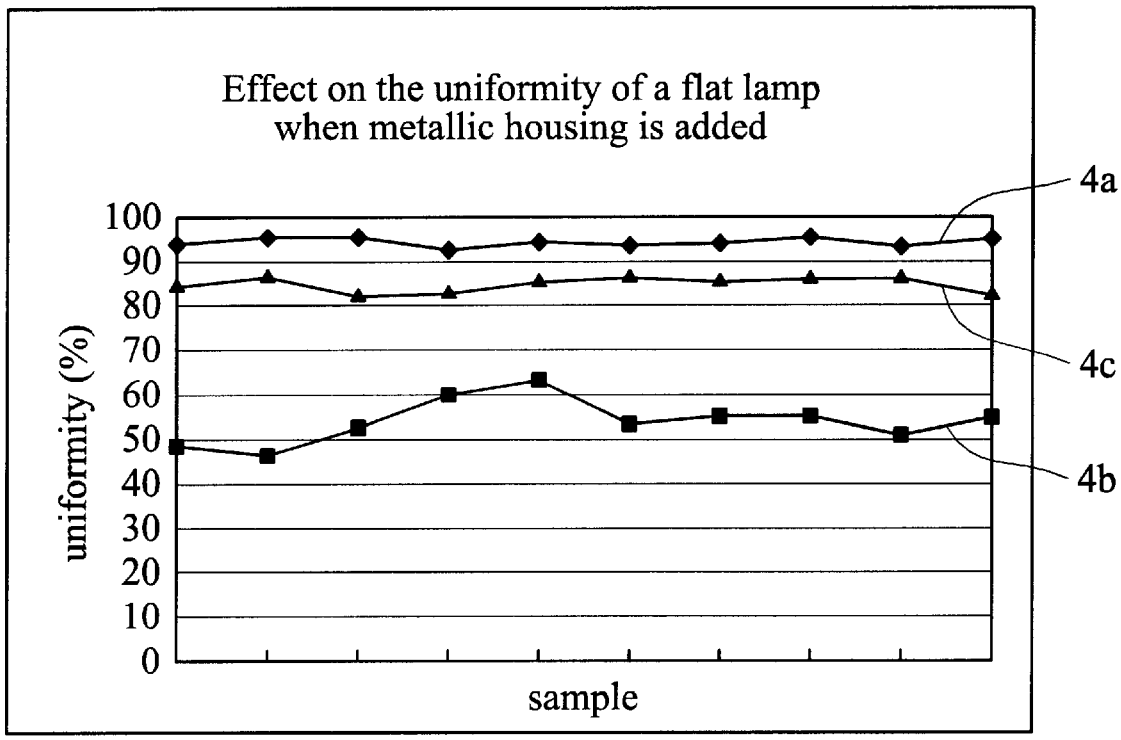
FIG. 4 shows the curves illustrating the effect on the uniformity of the flat lamp when a combined metallic housing is added in accordance with the invention.

FIG. 4 shows the curves illustrating the effect on the uniformity of the flat lamp when a combined metallic housing is added in accordance with the invention. As shown in FIG. 4, the abscissa represents ten samples of the flat lamp, and each sample has nine test points showing the luminance of average area (not shown in the figure). In addition, the ordinate represents the luminescent uniformity. Each sample's luminescent uniformity is defined as the percentage value of the lowest illumination to the highest illumination of the same samples showing among the illumination test points.

Curve 4*a* showing the luminescent uniformity of naked piece of the flat lamp before the combined metallic housing 40 is added. Curve 4*b* showing the luminescent uniformity of the flat lamp 30 after the integrated metallic housing 20(as shown in FIG. 1). Curve 4*c* showing the luminescent uniformity of the flat lamp 30 after the combined metallic housing 40 is added. From the curve 4*a*, 4*b* and 4*c* of the FIG. 4, we can see that the luminescent uniformity of the CCFFL 30 of fluorescent lamp module structure according to the invention is improved in a great extent. It varies from 90% average on the naked piece of the flat lamp to 50% average after assembling with the integrated metallic housing 20, then improves to 85% after assembling with the combined metallic housing 40. This is because that the assembling with integrated metallic housing 20 will affect the electric field when the flat lamp is operating and the assembling with combined metallic housing 40 will eliminate the effect in a great extent.

In the other embodiment, the combined metallic housing 40 is composed of two neighboring base plates, or four neighboring base plates. In general, the combined metallic housing 40 can also be composed of a plurality of neighboring base plates.

While the invention has been described by way of example and in terms of a preferred embodiment, it is to be understood that the invention is not limited to the disclose embodiment. On the contrary, it is intended to cover various modifications. Therefore, the scope of the appended claims should be accorded the broadest interpretation so as to encompass all such modifications.

What is claimed is:

1. A Fluorescent Lamp Module Structure comprising:

a Cold Cathode Flat Fluorescent Lamp (CCFFL), which is a rectangular box with a certain thickness including a $1^{st}$ side on the top, a $2^{nd}$ side on the bottom, a $3^{rd}$ side on the left and a $4^{th}$ side on the right wherein the $1^{st}$ side includes a $1^{st}$ end with a $1^{st}$ electrode on the left, a $2^{nd}$ end with a $2^{nd}$ electrode on the right, and a middle section having an exhaust tube positioned between the $1^{st}$ end and $2^{nd}$ end, a combined metallic housing for containing and positioning the CCFFL including a plurality of metallic housing cut from an integrated metallic housing that has a base plate and a plurality of upright pieces bent upward at a right angle to the base plate with a height close to the thickness of CCFFL, and the plurality of metallic housings is formed by a plurality of base plates, adjacent to one another, cut from the base plate area of the integrated metallic housing.

2. The fluorescent lamp module structure of claim 1, wherein the combined metallic housing is composed of a plurality of metallic housing portions and an insulated paster for combining the plurality of metallic housings.

3. The fluorescent lamp module structure of claim 1, wherein the borderlines of the metallic housing portions of the combined metallic housing are in between the $3^{rd}$ and $4^{th}$ sides of the CCFFL.

4. The fluorescent lamp module structure of claim 1, wherein the borderlines of the metallic housing portions of the combined metallic housing are in between the $1^{st}$ and $2^{nd}$ sides of the CCFFL.

5. The fluorescent lamp module structure of claim 3 or claim 4, wherein the combined metallic housing is composed of two metallic housing portions and an insulated paster for combining the two metallic housing portions.

6. The fluorescent lamp module structure of claim 1, wherein the combined metallic housing is formed by four neighboring metallic housing portions disposed in a form of up, bottom, left and right base plate areas.

7. The fluorescent lamp module structure of claim 6, wherein said combined metallic housing is composed of four metallic housing portions and an insulated paster for combining the four metallic housing portions.

* * * * *